United States Patent [19]

Sklar et al.

[11] Patent Number: 5,008,787

[45] Date of Patent: Apr. 16, 1991

[54] SYSTEM FOR INSULATED SUPPORT OF NEON LIGHTS

[76] Inventors: Albert Sklar; Barbara Sklar, both of 3513 Villa Ter., San Diego, Calif. 92104

[21] Appl. No.: 546,713

[22] Filed: Jul. 2, 1990

[51] Int. Cl.[5] ..... F21V 23/02

[52] U.S. Cl. ..... 362/221; 362/263; 362/265

[58] Field of Search ..... 362/263, 265, 221

[56] References Cited

U.S. PATENT DOCUMENTS 3,168,987 2/1965 Heisler ..... 362/221

4,352,539 10/1982 Vest ..... 362/221

*Primary Examiner*—Allen M. Ostrager

*Attorney, Agent, or Firm*—Brown, Martin, Haller & McClain

[57] ABSTRACT

A system for the insulated support of neon lights comprising a cylindrical glass cup having different diameter, longitudinal intersecting bores for receiving and securing together the respective ends of a cylindrical neon tube electrode and the cylindrical end of glass encased high voltage wire. A resilient O-ring encircles and holds together the respective end of the electrode and glass sleeve and the combination is slidably moved into the cylindrical insulating cup, with the O-ring being compressed between the inner surface of the cup and the outer surfaces of the electrode and glass sleeve, securing the combination within the cup.

5 Claims, 2 Drawing Sheets

SYSTEM FOR INSULATED SUPPORT OF NEON LIGHTS

BACKGROUND OF THE INVENTION

Neon light displays comprise a plurality of neon tubes that have illuminating conductive gases within the tubes. The neon tubes are electrically connected in series with the electrodes (which are the end of the neon tubes) being interconnected by high voltage wire.

Because there are no standardized enclosures for the connections of the electrodes to the high voltage wire, many different and haphazard approaches have been used to make these connections.

There is therefore a need to provide a new and improved insulation cup for the high voltage connection, but also to provide for a simplified and yet positive support to keep the insulating cup in place thereby not allowing the high voltage wires to become exposed.

SUMMARY OF THE INVENTION

This invention is based upon the realization by the inventor that many of the problems involved in the electrical connection of neon tubes can be eliminated or substantially reduced by using a particularly adapted insulating cup that is made of glass (which is a non-conductor of electricity); and that is particularly adapted for a simplified and yet positive securing of the respective electrically connected ends of the electrodes of high voltage wire. Since there are many connections of the ends of neon tubes in an entire neon display, the particularly adapted cylindrical insulator glass cup in the specific embodiment of this invention, can be used for ease of installation, positive retention of the respective electrodes together with glass-covered high voltage wire with a positive retention of the respective ends inside the insulated cup.

Further the outer configuration of the glass cup is such that a simplified bracket or cup can be conformed to the cup's outer configuration, providing a positive gripping and support of the insulated cup with the free end of the bracket being easily and securely attached to the wall or background.

The glass cup is preferably made of a heat-resistant type glass and comprises two aligned, intersecting longitudinal bores within the single, cylindrical inner volume. The respective bores are sized to conform with the cylindrical end of the electrode and with the insulating glass sleeve which encases the high voltage wire. The outer diameter of the wire-encased glass sleeve, which diameters conform to the diameters of the inner bores of the cup. A resilient O-ring encircles the adjacent ends of the electrode and glass sleeve, with the combination being slidably shoved into the volume of the glass cup, with the O-ring being resiliently compressed in the space between the inner surface of the glass cup and the outer surfaces of the electrode and the glass sleeve. This secures the electrode wires and the high voltage wires (which are within the glass sleeve) in position in the glass cup.

The O-ring is generally located just inside the open end of the glass cup, with the electrical connections of the electrode and high-voltage wires being made further within the volume of the glass cup.

The bracket comprises a relatively stiff, yet slightly flexible steel wire with one end shaped to conform to the larger outer diameter portion of the cylindrical glass cup, with the same end contacting the outer surface intersection of the larger and smaller longitudinal bores. This provides a positive gripping of the glass cup. The other end of the bracket is then conformed into a loop for being secured in any suitable manner directly to the wall or background. This provides a constant and uniform correct spacing of each of the supporting cylindrically glass cups and their enclosed ends of the electrodes and high-voltage wires encased in glass sleeves, providing a uniform and simplified yet positive combination support for the entire neon tube display.

It is therefore an object of this invention to provide a new and improved system for insulating of neon tube connections.

Other objects and many attended advantages of this invention will become more apparent upon a reading of the specification and an examination of the drawings, wherein like reference numerals designate like parts throughout and in which:

DESCRIPTION OF THE PREFERRED EMBODIMENT

Figure 1:
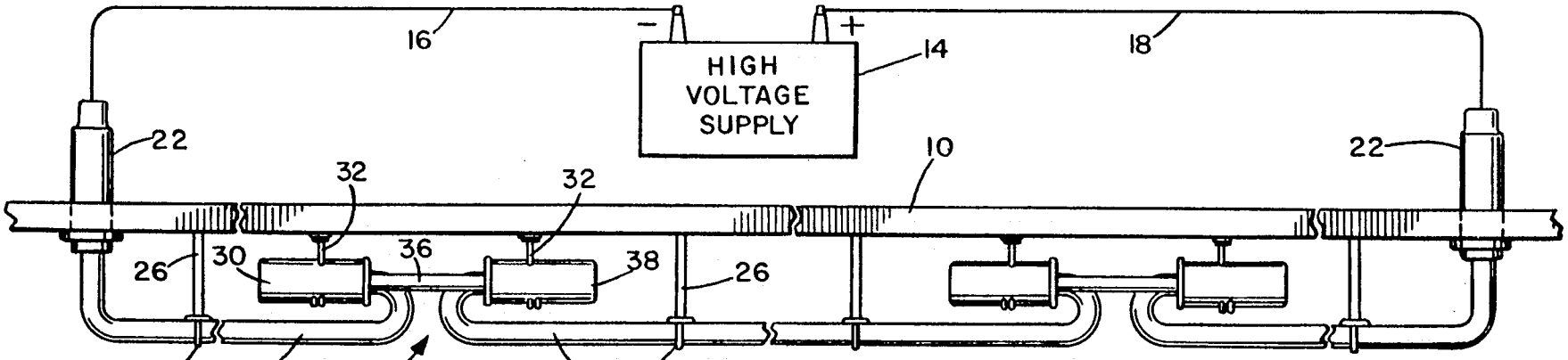
FIG. 1 is a top plan view of a typical neon lighting installation incorporating the glass cups.
Figure 2:
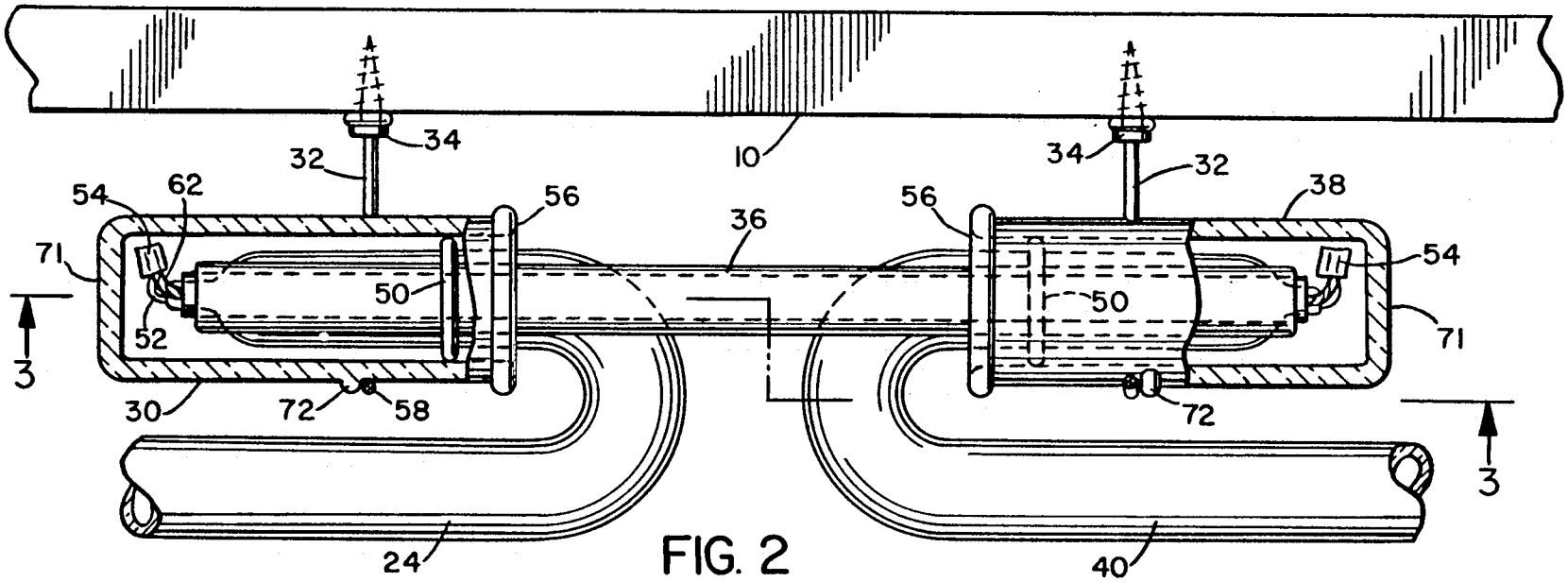
FIG. 2 is an enlargement of a portion of FIG. 1, with parts cut away.

Referring now to FIG. 1 a composite neon display 12 is secured to a wall or background 10 and is energized by high voltage supply 14. Respective segments of the neon display comprise individual neon tubes 24 and 40 that are connected in series by glass encased high voltage wire 36. The polarity is always in series through the entire neon display tube array.

Accordingly the current is fed through line 16 to an approved housing 22 that is connected to the back of the wall or background 10. The electrical line passes through the housing 22 to make connection with the end of the neon tube (the electrode) 24. Current flows through the neon tube 24 igniting the gas in the tube which creates the light. The electrode (end of neon tube 24) in accordance with this invention makes electrical connection in the glass cup 30 with one end of the high voltage wire which is encased in glass sleeve 36. The other end of the glass encased high voltage wire 36 in glass cup 38 makes electrical connection with the electrode of the next neon tube 40 in the circuit. The current is then conducted in the gas circuit of neon tube 40, and through respective connections of neon tube electrodes and glass encased high voltage wire to the point that the current eventually flows back to the voltage supply through line 18.

The neon light display is spaced by glass stands 26 that are connected at one end to the neon tubes by wires 28 with the other end fastened against the background 10 to form the spacer between the neon tube and the background, as is characteristic in neon displays. In this embodiment, the glass cup 30 secures and retains the respective ends of the neon tubes 24, 40. The cups are supported by the bracket 32 that provides additional support and stability for the neon tubes in the display.

The glass cup 30, see FIGS. 2–5, in the preferred embodiment is made of borosilicate glass. This is an excellent glass with high strength, durability heat-resistance and good insulation qualities. The cup 30 has a cylindrical shape with a uniform cylindrical configuration from the open end 56 to the closed end 71. There is an embossed beads 72 on exterior center portion of large bore to assist in correct positioning of gripping portion of bracket 58 onto glass cup 30. The configuration of the cylindrical glass cup is such that it comprises essentially two separate but interconnected, aligned longitudinal bores. The bore 55 has a smaller internal and external diameter than does the bore 57. Both bores, however, intersect along line 63, forming a slight indentation of the side of the cup 30.

Figure 3:
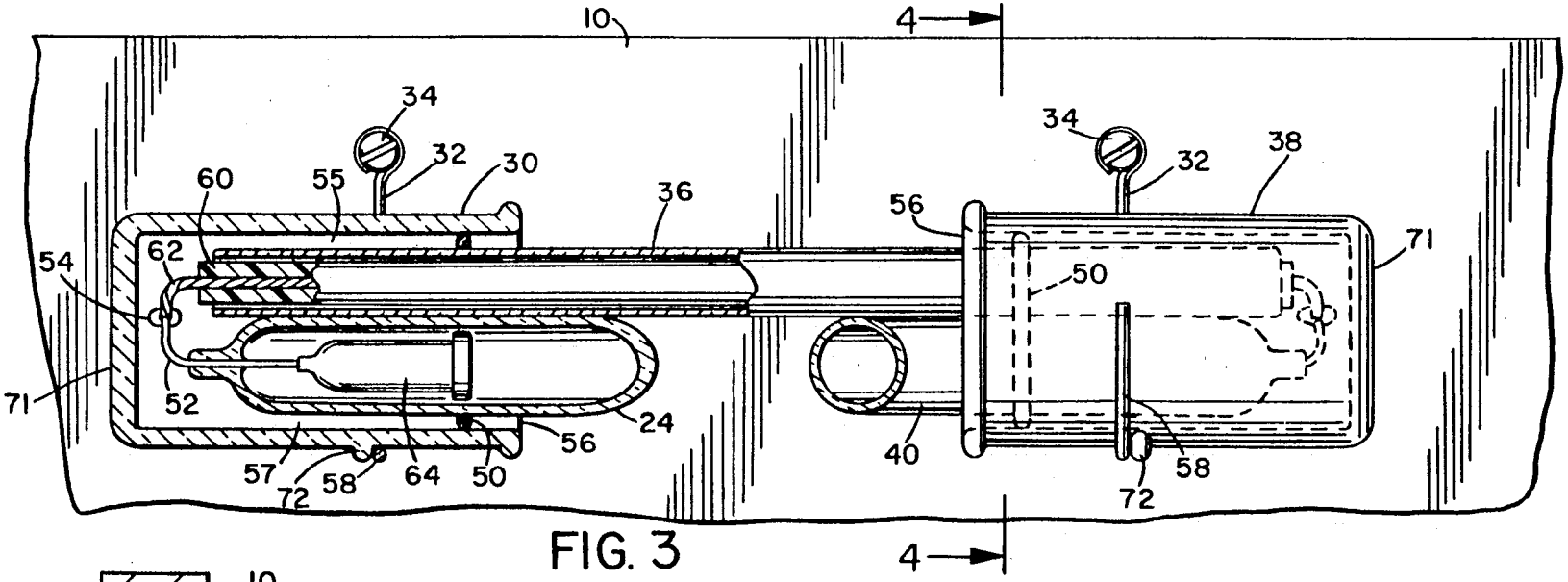
FIG. 3 is a sectional view taken on line 3—3 of FIG. 2.
Figure 5:
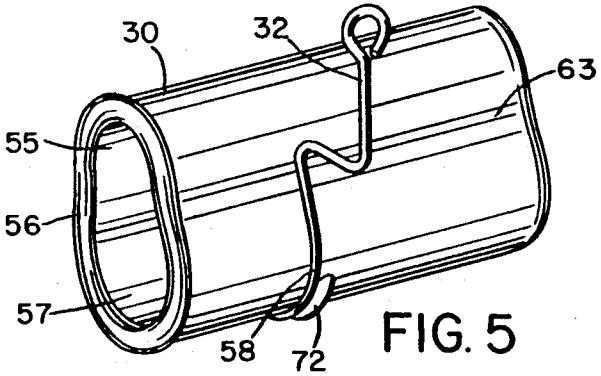
FIG. 5 is a perspective view of a glass cup and its mounting bracket.
Figure 4:
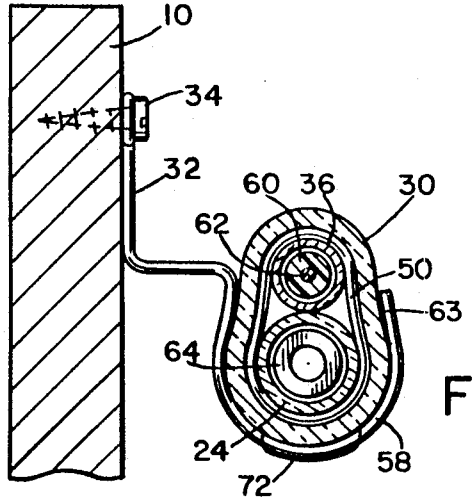
FIG. 4 is a sectional view taken on line 4—4 of FIG. 3.

The glass encased high voltage wire comprises an insulated single conductor having outer insulation 60 with a single inner wire 62, see FIG. 3. The insulated wire is positioned in a glass tube 36. The neon tube 24 contains a gas that is ignited by electrical current forming a conductor for the current through the tube to electrode wires 52 at the end of the tube 64 in FIG. 3. The glass encased high voltage wire 62 connects with the neon tube electrode wire 52 by securely twisting the wires together or use of a standard wire crimp sleeve 54. The outer diameter of the glass neon tube 24 is usually larger than the outer diameter of the glass sleeve 36. Accordingly, the inner diameter 55 of the glass cup 30 is slightly larger than the outer diameter 36 of the glass sleeve and the inner diameter 57 of the glass cup 30 is slightly larger than the outer diameter of the neon tube electrode 24. The cup is designed to enable electrodes of sizes varying from 10 MM to 18 MM to be insulated within the cup alongside the glass encased high voltage wire.

The object and purpose of the glass cup 30 is to enclose and hold the respective joined ends of the neon tube electrode 24 and glass encased high voltage wire 36. An O-ring 50 or other suitable rubber or resilient band encircles and resiliently hold together in position, the ends of glass sleeve 36 and the electrode 24. This combination is then slidably pushed through open end 56 into the glass cup 30 to the position illustrated in FIG. 3. In this position, the O ring is squeezed between the outer diameters of the respective electrodes and neon tube ends and the inner surface of the glass cup 30. This compression force is sufficient to positively hold the members together as illustrated in FIG. 3.

The bracket 32 is preferably made of stainless steel, and comprises a rigid wire having a slight flexibility, that is curved at the gripping end 58 to fit around the outer surface of the larger diameter portion of the glass cups. The end of the gripping end fits against the recessed side 63 of the glass cup creating a compression support of the glass cup 30. The bracket's free end 32 has an eyelet opening through which screw 34 passes securing the bracket and the glass cup in the correct spaced position on the background or wall 10.

So each of the respective connections of the glass encased high voltage wire and the electrodes of the neon tubes are securely held in position in the manner described relative to FIG. 3, and yet may be easily and quickly assembled or disassembled by movement of the cup 30 relative to the respective end of the neon tube 24 and the glass encased high voltage wire 36, pulling the connected ends through opening 56.

It is not the purpose of the O-ring 50 to provide a sealed cavity within the glass cup 30 since sealed insulated connections are not required for the single polarity connection of the electrode end of the neon tube. However, the O-ring does provide a restricted opening in its compressed condition in the installation.

IN OPERATION

In operation, the neon tubes are mounted on tube supports 26. The glass encased high voltage wire 62 is attached to the neon tube electrode wires 52 and is held in place by the O-ring 50. The mounting bracket gripping end 58 is attached to the cup 30. The glass cup 30 with bracket 58 is slid into position over the O-ring 50, slightly compressing the O-ring and forcing it to roll inside the glass cup as the cup slides over; thereby firmly holding the glass encased high voltage wire and the neon tube electrode in place inside the cup 30. See FIG. 3. The bracket 32 is secured in position by screws or other mounting fasteners 34 to the background 10.

Having described my invention, I now claim:

1. In the installation and support of neon tubes having cylindrical glass encased high voltage wires electrically connected to the cylindrical ends of neon tubes, the improvement comprising:

a cylindrical glass cup having two aligned, intersecting and joined longitudinal bores;

the cylindrical end of the glass encased high voltage wire being slidably positionable in one bore and the cylindrical end of the neon tube being slidably positionable in the other bore;

a resilient O-ring for encircling the two adjacent ends of the respective glass sleeve and neon tube electrode, and said O-ring being resiliently compressible in the space between the inner surface of the glass cup and the outer surfaces of the electrode and glass sleeve, holding the electrode and glass sleeve in position in the glass cup.

2. In the installation and support of neon tubes as claimed in claim 1 in which:

the outer surface of said glass cup comprising two, joined, aligned and intersecting cylinders having different diameters, and a bracket having one end conforming to and gripping the outer intersecting surface of the larger cylindrical portion for supporting the glass cup and the respective ends of the electrode and glass sleeve.

3. In the installation and support of neon tubes as claimed in claim 2 in which, said bracket having a wire shape, with the free end opposite said end for gripping said glass cup having a connector loop for being connected to a background support, spacing said glass cup from the background support.

4. In the installation and support of neon tubes as claimed in claim 1 wherein:

said cup having an open end, said O-ring being compressed around the respective electrode and glass encased high voltage wire at a point adjacent said open end, and means for electrically connecting the respective ends of the electrode and the glass encased high voltage wire within the volume of the glass cup defined by the position of the O ring.

5. A system for the insulated support of components of a neon light comprising:

a plurality of neon tubes having at their adjacent ends, interconnecting glass encased high voltage wire, said glass sleeves and neon tube electrodes comprising glass cylinders, cylindrical insulator cups each having two longitudinal, joined and intersecting bores with different diameters, a cylindrical end of an electrode being slidably positioned in one bore and the cylindrical end of a glass sleeve being slidably positioned in the other bore, a resilient O-ring for encircling two adjacent ends of the respective electrodes and glass sleeves, said O-ring being resiliently compressed in the space between the inner surface of the glass cup and outer surfaces of the neon tube electrode and glass sleeve, holding the neon electrode and glass sleeve in position in the glass cup, the outer surface of the insulator cup comprising two aligned intersecting cylinders having different diameters, and a bracket having one end conforming to and gripping the outer, intersecting surface of the larger cylindrical portion of the glass cup for supporting the glass cup and the respective ends of the neon tube electrode and glass encased high voltage wire in position.

* * * * *